US005806229A

United States Patent [19]

Daz et al.

[11] Patent Number: 5,806,229

[45] Date of Patent: Sep. 15, 1998

[54] AIMING AID FOR USE WITH ELECTRONIC WEAPON SIGHTS

[75] Inventors: Lino C. Daz, Plano; Charles M. Hanson, Richardson, both of Tex.

[73] Assignee: Raytheon TI Systems, Inc., Lewisville, Tex.

[21] Appl. No.: 881,819

[22] Filed: Jun. 24, 1997

[51] Int. Cl.[6] ..... F41C 27/06

[52] U.S. Cl. ..... 42/105

[58] Field of Search ..... 42/103, 101, 100; 89/41.17, 41.19, 41.06, 41.05; 33/277; 250/338.1; 244/3.11

[56] References Cited

U.S. PATENT DOCUMENTS 4,027,159 5/1977 Bishop ..... 250/338
4,804,843 2/1989 Hall ..... 250/330
4,976,038 12/1990 Nattrass ..... 333/233
5,272,514 12/1993 Dor ..... 356/251
5,675,112 10/1997 Giry et al. ..... 89/41.06

*Primary Examiner*—Charles T. Jordan
*Assistant Examiner*—Meena Chelliah
*Attorney, Agent, or Firm*—Baker & Botts, L.L.P.

[57] ABSTRACT

An aiming system is provided which includes two sensors. The two sensors sense two respective images of the same object relative to a common reference point. An offset is determined between the respective images of the object. An aiming point is provided on the second image and is spaced from the reference point according to the offset. The aiming point indicates the direction and distance to which the first sensor must be moved to be aligned with the object.

19 Claims, 1 Drawing Sheet

AIMING AID FOR USE WITH ELECTRONIC WEAPON SIGHTS

TECHNICAL FIELD OF THE INVENTION

This invention generally relates to aiming aids and, more particularly, to an aiming aid for use with electronic sights for weapons.

BACKGROUND OF THE INVENTION

Aiming aids are generally known, and are typically provided for various applications including the aiming of weapons. For example, it is commonly known that a weapon can be provided with a sight to assist the user of the weapon in aiming the weapon toward a target. For instance, a sight may be coupled to the barrel of a rifle. The user can then view the target through the sight, which normally has been pre-aligned with the barrel. Often, as in the case of a typical rifle scope, the sight includes an eyepiece of one form or another through which the user views the target. The eyepiece essentially provides a display upon which may be superimposed a reticle for giving further assistance to the user in aligning the weapon relative to the target.

Often it is impossible for a user to directly view a target through a sight which is coupled to a weapon. For example, the user may be in a helicopter or tank, or otherwise positioned away from the weapon, or barrel thereof. Also, if a user is wearing certain types of headgear, such as chemical warfare gear or night vision goggles, the user might not be able to readily view the target through the eyepiece of a weapon-mounted sight. In these instances it may be necessary to aim the weapon indirectly. This, however, reduces the likelihood of hitting the target.

Under other circumstances, it is necessary to aim a weapon during a period, or under conditions, of darkness. Night vision equipment is generally known and allows a user to detect images which might not be visible to the naked eye due to the dark environment. One type of night vision equipment operates under the general principle of detecting infrared radiation emitted by an object and distinguishing this infrared radiation from background radiation. One or more thermal sensors may detect and convert the incoming radiance to electrical signals which are then amplified and processed to produce a visual display. Night vision optics may be incorporated into a sight which is mounted to a weapon. However, for the user to view the surroundings, it is necessary to point the weapon toward the general area which the user wishes to view. The user then must view the area through the sight mounted on the weapon.

A user may wear night vision goggles to provide greater flexibility in the viewing of objects during darkness. Night vision goggles also provide a greater freedom of movement, since they can be mounted to the head via straps for hands-free usage. However, as described above, if the user is wearing night vision goggles, viewing through a weapon-mounted sight is difficult, if not impossible.

SUMMARY OF THE INVENTION

Therefore, a need has arisen for an aiming system for a weapon which allows remote sighting of a target such that the remote sight accurately displays the alignment of the weapon relative to the target.

Accordingly, an aiming system is provided, in which two spaced-apart sensors sense an image of an object. One sensor senses the image relative to a reference point. An offset is determined between the two sensed images. An aim point is provided on a display associated with the other sensor such that the aim point is spaced from the reference point according to the previously-determined offset.

In one embodiment, a first sensor senses a first image of an object. A second sensor senses a second image of the object. A display displays an aiming point on the second image such that the position of the aiming point is determined by comparing the relative positions of the first and second images.

According to one aspect, the first and second images are sensed in relation to a reference point. An offset is determined between the first and second images. The aim point is spaced from the reference point according to the offset.

According to another aspect at least one of the sensors senses the image in the infrared spectrum. One sensor may sense an image in the infrared spectrum while the other senses the image in the visual spectrum. Alternatively, both of the sensors may sense their respective images in either the infrared or the visual spectrum.

According to another aspect, at least one of the sensors is a passive sensor. In this situation, the sensor senses the image without first actively imparting a signal, such as a light beam, to the object or target being sensed.

A technical advantage of the present invention is that a target may be sighted with one sight mounted on a weapon, and the offset of the weapon relative to a target may be displayed on a display associated with a remote sight. Therefore, remote sighting is provided.

Another technical advantage is that, in certain applications, one of the sensors and a display may be incorporated into headgear such as night vision goggles. This allows the user to accurately view the target through the night vision goggle display, with an aim point being superimposed on the goggle display, which indicates the direction of the weapon relative to the target. This feature allows the user to aim the weapon from a variety of orientations, such as from the hip or held up above the head so that the user does not have to view the target through the weapon-mounted sight.

Another technical advantage, as is the case with passive sensing, is that a user may use the aiming system without being detected by another person or by detection equipment.

Other aspects, features, and advantages will be easily recognized by those having ordinary skill in the pertinent art by referring to the detailed description of the preferred embodiments and the accompanying figures.

BRIEF DESCRIPTION OF THE DRAWINGS

For a better understanding of the present invention, reference may be had to the accompanying drawings, in which.

DETAILED DESCRIPTION OF THE PREFERRED EMBODIMENTS

The present invention provides an aiming aid which may be used with electronic sights for weapons. However, the present invention is not limited to this application. The aiming aid provides the ability to remotely align a weapon toward a target. In at least one embodiment of the present invention, this is accomplished by using two sensors, one of which is aligned relative to a weapon and the other of which is spaced apart from the first sensor. The two sensors sense respective images of the same target. These images are correlated to determine an offset therebetween with respect to a reference point. The offset is, in turn, used to determine the location of an aim point which is displayed in connection with the spaced-apart sensor. The aim point is spaced from the reference point according to the distance and direction of the offset.

Figure 2:
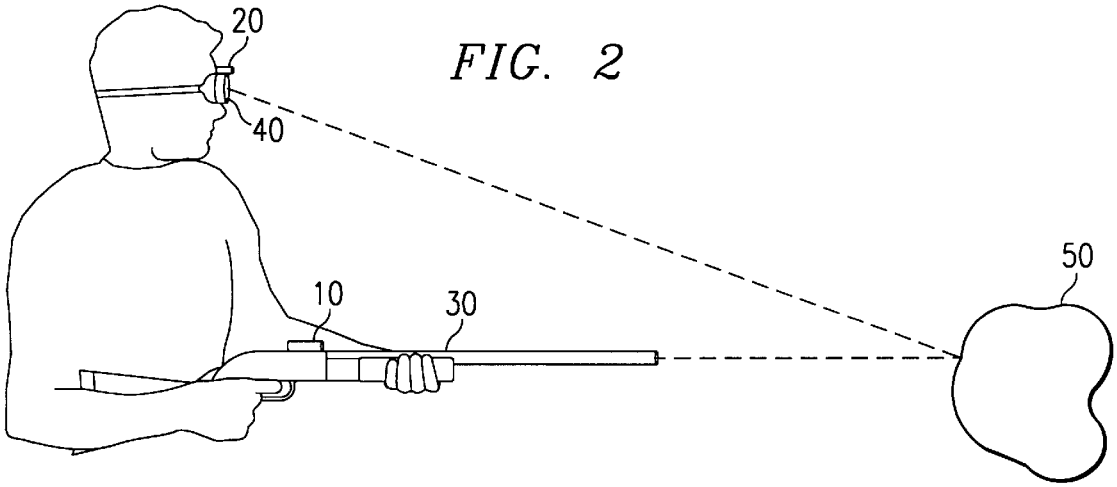
FIG. 2 is a profile of a user using an aiming system in accordance with an embodiment of the present invention.

In greater detail, and referring to FIG. 2, an aiming aid includes a first sensor 10, which is mountable on weapon 30 and a second sensor 20, which is mountable on or with optical device 40. First and second sensors 10 and 20 sense respective first and second images of target 50. These images are then correlated to determine the offset between the respective images. This offset is used to determine how far and in what direction an aim point must be spaced from a reference point in a display associated with optical device 40. When the aim point is displayed and properly spaced from the reference point, the aim point indicates the direction and distance which the weapon must be moved to be aligned with the target. Thus, the user need not view the target through a sight on the weapon or otherwise associated with the first sensor 10.

Figure 1:
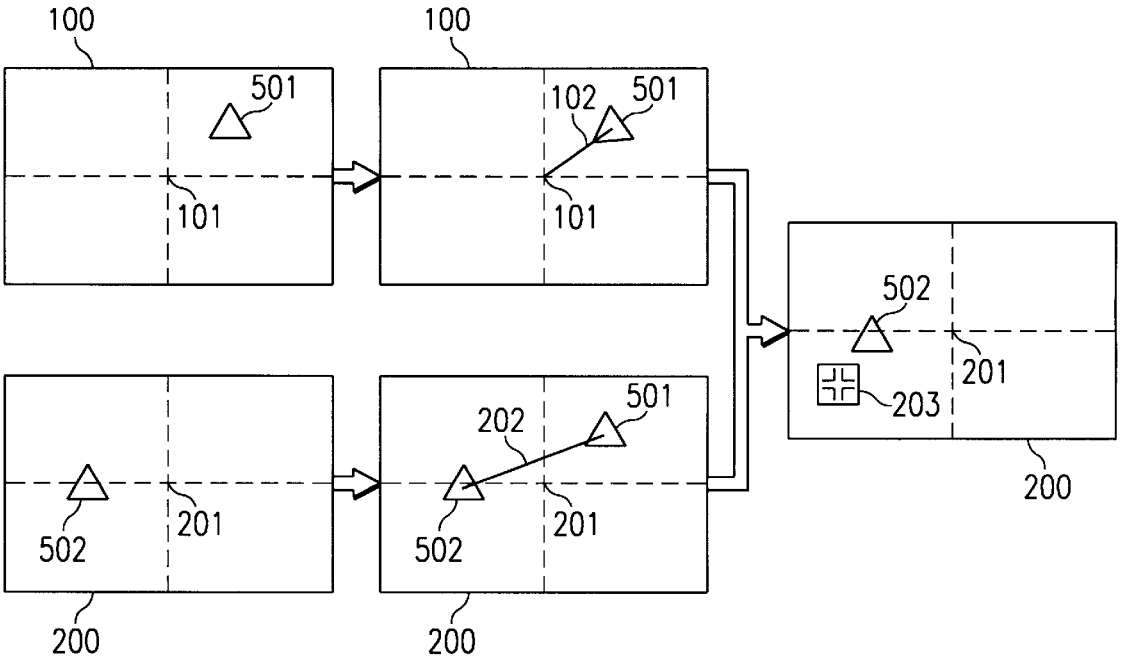
FIG. 1 is a schematic of images displayed in association with sensors and depicting the determination of an offset and the display of an aim point in accordance with an embodiment of the present invention.

With further reference to FIG. 1, first image 100 corresponds to the image sensed by first sensor 10. Second image 200 corresponds to the image sensed by second sensor 20. First image 100 has a first reference point 101 associated therewith. Similarly, second image 200 has a second reference point 201 associated therewith. Preferably, first and second reference points 101 and 201 correspond such that if first and second sensors 100 and 200 were aligned, and their respective images of the target were aligned with one another, first and second reference points 101 and 201 would overlay one another. This is not critical, however, since a displacement between first and second reference 101 and 201 may be compensated for.

First image 100 includes a first image 501 of target 50. Second image 200 includes a second image 502 of target 50. First and second images 100 and 200 may be sensed and relative movement of target 50 within the images may be sensed using centroid tracking technology, for example. However, any kind of target recognition and tracking technology currently available may be used.

Preferably, first and second sensors 10 and 20 sense target 50 in the infrared spectrum. In other words, first and second sensors 10 and 20 are adapted to sense infrared radiation emitted by target 50. The sensors should also be able to eliminate the effects of any background infrared radiation. Alternatively, one or both sensors sense target 50 in the visible spectrum. Where target 50 is sensed in the infrared spectrum, the target may be passively sensed. In other words, there is no signal emitted from the sensor toward the target to aid in providing an image of the target. For example, some active-type sensors emit a signal, such as a beam of light or an electronic signal, which the target reflects. The reflection is sensed by the active-type sensor and processed to provide the image. The active signal may be intercepted by a detection device. Therefore, in contrast to an active system, the passive system may be used without detection by a device or another person such as an enemy. Even though it is preferable to use passive sensing, the present invention can incorporate active sensing. For example, the sensor can emit a beam of light to the target and sense a reflection of that beam of light.

Preferably, first sensor 10 is mounted on a weapon such as a rifle. Even more preferably, first sensor 10 is mounted on the barrel of the weapon. First sensor 10 and weapon 30 may be pre-aligned such that a projectile fired from weapon 30 will follow the direction indicated by first reference point 101 of first image 100. Therefore, if first reference point 101 overlays first image 501 of target 50, a projectile fired from weapon 30 will strike target 50. It should be noted that pre-alignment, as is known, may be dependent upon distance to the target and trajectory of the projectile.

First sensor 10 can be mounted on any of a number of different types of weapons. For example, first sensor 10 could be mounted on the barrel of a tank or on a gun which itself is mounted to the exterior of a helicopter. Also, first sensor 10 could be mounted on a missile or on any similar projectile to which first sensor 10 could be secured. Further, first sensor 10 need not, in all cases, be mounted directly to the weapon. Regardless of the location of first sensor 10 it is preferable that in order to successfully strike the target, first sensor 10 be pre-aligned with weapon 30 and also be adapted to move in accordance with movement of weapon 30. For instance, if weapon 30 is moved up or down or left or right, first sensor 10 should be adapted to likewise move up or down or left or right so that after pre-alignment, first sensor 10 and weapon 30 are always directed to the same point in space.

Preferably, second sensor 20 is spaced apart from first sensor 10. As shown in FIG. 2, second sensor 20 is mounted on optical device 40. However, second sensor 20 may be mounted on any other part of the user or gear which the user is wearing. Additionally, as in the case with first sensor 10, second sensor 20 need not be mounted directly on the user. Regardless of the location of second sensor 20, the user should be able to view a display associated with second sensor 20. Preferably, the display provides a display of second image 200 as shown in FIG. 1. For instance, second sensor 20 may be mounted to a remote display which is not itself mounted to the user. Optionally, second sensor 20 may be mounted to a device which provides the associated display and the device itself may be mounted to the user. As shown in FIG. 2, for example, optical device 40 which incorporates second sensor 20, may comprise night vision goggles. However, any suitable optical device may be used. As an alternative to night vision goggles, for example, the present invention can incorporate a head-mounted CCD camera as well as a weapon-mounted CCD camera Night vision goggles may themselves include a display for second sensor 20. As another alternative, second sensor 20 may be remotely located from the user while the associated display for second sensor 20 is mounted to the user. In this case, second image 200 would be transmitted to the user-mounted display by any known method for image transmission.

Preferably, the aiming system is further provided with a computer which is adapted to receive first and second images 100 and 200. The computer should include a processor for processing first and second images 100 and 200 and for determining an offset 202 between the first image 501 of target 50 and the second image 502 of target 50. The processor may be coupled to the sensors using any known coupling technique including electronic transmission of signals between the two sensors and the processor, or by directly coupling these components with a suitable cable connection. The step of determining the offset is most clearly shown in FIG. 1. The offset may be determined by any of a number of known correlation techniques incorporated in various correlation software programs. Optionally, the offset may be determined by using centroid tracking technology. Preferably, the images are aligned according to a pixel-by-pixel technique. According to one example, it might be determined that, if first and second reference points 101 and 102 are aligned, second image 502 of target 50 is seven pixels down and twelve pixels to the left of first image 501 of target 50. Thus, offset 202 preferably has both distance and direction components such that offset 202 may be described as a vector. Further, since two sensors are sensing respective images of an actual object, a comparison is being made between two actual images in real time. This is different from, for example, comparing an actual image to a manufactured image, such as a previously-made picture.

Offset 202 is used to determine the position of an aim point 203 which is displayed in connection with second image 200. Aim point 203 may, for example, be either provided on image 200 or superimposed thereon. Preferably, aim point 203 is spaced from second reference point 201 according to offset 202. Therefore, in the case of the above-described example, aim point 203 would be located seven pixels down and twelve pixels to the left of second reference point 201. When aim point 203 displayed, it is spaced from second image 502 of target 50 according to vector 102. Vector 102 is defined by the direction and distance which first image 501 of target 50 is spaced from first reference point 101 in first image 100. Aim point 203 may be provided as a reticle, such as cross hairs or a cross symbol similar to that displayed in the viewfinder of a conventional rifle scope. Aim point 203 indicates the alignment of weapon 30 (via first sensor 10) relative to target 50.

In operation, a user controls the movement of a weapon either by directly moving the weapon with his hands or another portion of his body or by indirectly moving the weapon through any suitable means such as a servo-type control system. The first sensor which is associated with the weapon senses a first image of the target relative to a first reference point. The second sensor, spaced from the first sensor, senses a second image of the target. Preferably, the second image is sensed relative to the same or a corresponding reference point. The user views the second image of the target through a display associated with the second sensor. The offset between the first and second images of the target is determined as described above and the aim point is displayed in the display which the user views. The user may then adjust the alignment of the weapon relative to the target as necessary according to the direction and distance which the aim point is spaced from the target in the second image.

Although the present invention has been described in detail in connection with the preferred embodiments, those having ordinary skill in the pertinent art will easily recognize that modifications may be made to the preferred embodiments without departing from the scope and spirit of the present invention. For example, the aiming aid may be used for other applications besides the aiming of weapons. For example, the present invention may be used to assist in the control of steer-mounted weapons. As another example, the present invention may be used to provide aiming assistance with respect to telescopes or other optical devices, such as may be found in surveying systems.

What is claimed is:

1. An aiming system comprising:

a first sensor for sensing a first image of an object relative to a first reference point, a vector being defined between the first reference point and the first image;

a second sensor for sensing a second image of the object relative to a second reference point;

a processor coupled to the first and second sensors for determining an offset between the first and second images;

a display associated with the second sensor for displaying the second image; and means for displaying an aim point on the display, the aim point being spaced from the second reference point according to the offset, and being spaced from the second image according to the vector.

2. The aiming system of claim 1, wherein at least one of the first and second sensors is adapted to sense images in the infrared spectrum.

3. The aiming system of claim 1, wherein at least one of the first and second sensors is adapted to sense images in the visible spectrum.

4. The aiming system of claim 1 wherein the processor is adapted to determine the offset by image correlation.

5. The aiming system of claim 1, wherein at least one of the first and second sensors is a passive sensor.

6. The aiming system of claim 1, wherein each of the first and second sensors is a passive sensor.

7. The aiming system of claim 1, wherein the first and second images are actual images.

8. The aiming system of claim 1, wherein the system is adapted to be used by a user, and includes a weapon, the first sensor being mounted on the weapon, and the second sensor being mounted on the user.

9. An aiming system comprising:

a first sensor for sensing a first image of an object relative to a first reference point;

a second sensor for sensing a second image of the object relative to a second reference point;

a processor coupled to the first and second sensors for determining an offset between the first and second images;

a display associated with the second sensor for displaying the second image; and means for displaying an aim point on the display, the aim point being spaced from the second reference point according to the offset:

wherein the processor is adapted to determine the offset by making a pixel-by-pixel comparison between the first and second images.

10. An aiming system comprising:

a first sensor for sensing a first image of an object relative to a first reference point; a second sensor for sensing a second image of the object relative to a second reference point;

a processor coupled to the first and second sensors for determining an offset between the first and second images;

a display associated with the second sensor for displaying the second image; and means for displaying an aim point on the display, the aim point being spaced from the second reference point according to the offset;

wherein the processor is adapted to determine the offset by centroid tracking.

11. An aiming system comprising:

a first sensor for sensing a first image of an object relative to a first reference point;

a second sensor for sensing a second image of the object relative to a second reference point;

a processor coupled to the first and second sensors for determining an offset between the first and second images;

a display associated with the second sensor for displaying the second image; and means for displaying an aim point on the display, the aim point being spaced from the second reference point according to the offset;

wherein the first and second images are pre-aligned to determine a first alignment, the aiming system further including a gyro for tracking a deviation from the first alignment to determine a second alignment, and wherein the processor determines the offset by comparing the first alignment to the second alignment.

12. An aiming system comprising:

a first sensor for sensing a first image of an object relative to a first reference point;

a second sensor for sensing a second image of the object relative to a second reference point;

a processor coupled to the first and second sensors for determining an offset between the first and second images;

a display associated with the second sensor for displaying the second image;

means for displaying an aim point on the display, the aim point being spaced from the second reference point according to the offset; and an optical unit;

wherein the second sensor and the display are disposed within the optical unit; and wherein the optical unit includes night vision goggles.

13. An aiming system comprising:

first sensing means for sensing a first image of an object;

second sensing means for sensing a second image of the object:

display means for displaying an aim point on the second image; and comparing means for comparing the relative positions of the first and second images to determine the location of the aim point;

wherein the first sensing means senses the first image relative to a reference point, a vector being defined between the reference point and the first image;

wherein the second sensing means senses the second image of the object relative to the reference point;

wherein the comparing means is coupled to the first and second sensing means to determine an offset between the first and second images; and wherein the aim point is spaced from the reference point according to the offset and is spaced from the second image according to the vector.

14. The aiming system of claim 13, wherein at least one of the first and second sensing means is adapted to passively sense an image of the object.

15. The aiming system of claim 13, wherein at least one of the first and second sensing means is adapted to sense infrared radiation from the object.

16. The aiming system of claim 13, further including propelling means for propelling a projectile toward the object, the first sensing means being coupled to the propelling means, and the second sensing means being spaced apart from the propelling means.

17. A method of aiming comprising the steps of:

sensing a first image of an object relative to a reference point;

defining a vector between the reference point and the first image;

sensing a second image of the object relative to the reference point;

comparing the first and second images to determine an offset therebetween;

displaying the second image on a display;

providing an aim point on the display; and spacing the aim point from the reference point according to the offset, and from the second image according to the vector.

18. The aiming method of claim 17, wherein at least one of the steps of sensing the first and second images includes the step of passively sensing an image of the object.

19. The aiming method of claim 17, wherein at least one of the steps of sensing the first and second images includes the step of sensing infrared radiation from the object.

* * * * *